US011236709B2

(12) United States Patent
Kim et al.

(10) Patent No.: US 11,236,709 B2
(45) Date of Patent: Feb. 1, 2022

(54) COOLING WATER FLOW CONTROL DEVICE OF COOLING SYSTEM FOR VEHICLE

(71) Applicants: HYUNDAI MOTOR COMPANY, Seoul (KR); KIA MOTORS CORPORATION, Seoul (KR)

(72) Inventors: Han Sang Kim, Ansan-si (KR); Jung Joo Park, Gunpo-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 17/029,258

(22) Filed: Sep. 23, 2020

(65) Prior Publication Data

US 2021/0180543 A1 Jun. 17, 2021

(30) Foreign Application Priority Data

Dec. 12, 2019 (KR) ..... 10-2019-0165713

(51) Int. Cl.

| | |
|---|---|
| ***F02M 26/32*** | (2016.01) |
| ***F01P 7/16*** | (2006.01) |
| ***F02M 26/33*** | (2016.01) |
| ***F02M 26/24*** | (2016.01) |
| ***F02M 26/28*** | (2016.01) |
| *F01P 7/14* | (2006.01) |

(52) U.S. Cl.

CPC ..... *F02M 26/32* (2016.02); *F01P 7/165* (2013.01); *F02M 26/24* (2016.02); *F02M 26/28* (2016.02); *F02M 26/33* (2016.02); *F01P 2007/146* (2013.01); *F01P 2025/32* (2013.01)

(58) Field of Classification Search

CPC ..... F02M 26/32; F02M 26/33; F02M 26/34; F02M 26/28; F01P 5/10; F01P 2007/146; F01P 3/20; F01P 7/165; F01P 7/14; F01P 2025/32

See application file for complete search history.

(56) References Cited

U.S. PATENT DOCUMENTS

| | | | | |
|---|---|---|---|---|
| 2013/0213600 | A1* | 8/2013 | Saitoh | F01P 7/16 165/11.1 |
| 2016/0341101 | A1* | 11/2016 | Shikata | F01P 7/16 |
| 2017/0370271 | A1* | 12/2017 | Lee | F02F 1/14 |
| 2018/0252144 | A1* | 9/2018 | Shimatani | F01P 7/16 |
| 2019/0120178 | A1* | 4/2019 | Park | F02D 41/0077 |
| 2019/0136743 | A1* | 5/2019 | Park | F01P 3/20 |
| 2019/0170049 | A1* | 6/2019 | Hasegawa | F01P 7/165 |

(Continued)

*Primary Examiner* — George C Jin

(74) *Attorney, Agent, or Firm* — Lempia Summerfield Katz LLC

(57) ABSTRACT

A cooling water flow control device of a cooling system for a vehicle can shorten a warm-up time of a cooling water being supplied to an exhaust gas recirculation (EGR) cooler. The cooling water flow control device includes: the EGR cooler that cools an exhaust gas supplied to an intake system of an engine using cooling water and includes an EGR cooler outlet through which the cooling water is discharged; a water pump to circulate the cooling water to the EGR cooler and the engine at an engine startup; and a direct flow path connected to a vent hole formed in the engine to guide the cooling water from the vent hole to a downstream side of an EGR cooler outlet.

10 Claims, 6 Drawing Sheets

(56) References Cited

U.S. PATENT DOCUMENTS

| | | | | |
|---|---|---|---|---|
| 2020/0232412 | A1* | 7/2020 | Watanabe | F01P 11/08 |
| 2020/0263639 | A1* | 8/2020 | Yang | F01P 3/12 |
| 2021/0040878 | A1* | 2/2021 | Matsumoto | F01P 3/12 |
| 2021/0231046 | A1* | 7/2021 | Park | F01P 5/10 |
| 2021/0239030 | A1* | 8/2021 | Xu | F01P 5/10 |

* cited by examiner

COOLING WATER FLOW CONTROL DEVICE OF COOLING SYSTEM FOR VEHICLE

CROSS-REFERENCE TO RELATED APPLICATION

This application claims priority to and the benefit of Korean Patent Application No. 10-2019-0165713, filed on Dec. 12, 2019, the entire contents of which are incorporated herein by reference.

FIELD

The present disclosure relates to a cooling water flow control device of a cooling system for a vehicle.

BACKGROUND

The statements in this section merely provide background information related to the present disclosure and may not constitute prior art.

In general, an exhaust gas recirculation (EGR) cooler serves to lower the temperature of an engine exhaust gas in the process of recirculating the exhaust gas to an intake system. The exhaust gas that is supplied to the engine through the EGR cooler is re-burnt, and thus nitrogen oxide included in the exhaust gas is burnt to be able to reduce toxic substances of the exhaust gas being discharged out of the vehicle.

Such an EGR cooler cools the exhaust gas using cooling water that is used for engine cooling. For this, the EGR cooler is configured so that heat can be exchanged between the cooling water being supplied through a water pump and the exhaust gas being supplied from an exhaust system.

According to the EGR cooler in the related art, in order to secure durability for the high-temperature exhaust gas, the cooling water may circulate before the cooling water circulates in the engine at the engine startup, and in this case, the cooling water circulating in the EGR cooler has a temperature that is lower than the temperature of the cooling water being stored in a water jacket provided inside the engine.

According to the EGR cooler as described above, the cooling water having the temperature that is lower than the temperature of the cooling water inside the engine constantly circulates from the initial engine startup, and this may cause a warm-up time of the cooling water on the EGR cooler to be lengthened.

Meanwhile, if the temperature of the cooling water circulating in the EGR cooler is equal to or lower than a predetermined cold temperature, condensate water is created in the EGR cooler, and in severe cases, a large amount of condensate water is created and gathered in the EGR cooler.

The condensate water being created in the EGR cooler is high-density acidic condensate water, and thus it causes corrosion to occur on the inside of the EGR cooler. If the inside of the EGR cooler is corroded, the cooling water is mixed with the recirculating exhaust gas being supplied to the engine, and thus engine failure may occur to cause very dangerous situations.

According to the EGR system in the related art, if the temperature of the cooling water in the EGR cooler is equal to or lower than the predetermined temperature, the EGR cooler does not operate, and if the EGR cooler is unable to be used as described above, it is not possible to improve the vehicle fuel economy through the operation of the EGR cooler.

The above information disclosed in this background section is only for enhancement of understanding of the background of the present disclosure and therefore it may contain information that does not form the prior art that is already known to a person of ordinary skill in the art.

SUMMARY

The present disclosure provides a cooling water flow control device of a cooling system for a vehicle, which can shorten a warm-up time of a cooling water being supplied to an EGR cooler by shortening the warm-up time desired to increase the temperature of the cooling water being supplied from the EGR cooler to a water pump up to a proper temperature at an engine startup.

For this, the cooling water flow control device as described above is configured to be able to supply a part of the cooling water being discharged from the inside of the engine toward a cooling water outlet of the EGR cooler for a predetermined time at the engine startup.

The objects of the present disclosure are not limited to those as described above, and other unmentioned objects of the present disclosure can be understood by the following explanation, and can be known more clearly by forms of the present disclosure.

In one aspect of the present disclosure, a cooling water flow control device of a cooling system for a vehicle includes: an EGR cooler configured to cool an exhaust gas supplied to an intake system of an engine using cooling water and including an EGR cooler outlet through which the cooling water is discharged, wherein the engine is provided with an engine outlet and a vent hole for discharging the cooling water; a water pump configured to circulate the cooling water to the EGR cooler and the engine at an engine startup; and a direct flow path connected to the vent hole and configured to guide the cooling water from the vent hole to a downstream side of the EGR cooler outlet.

In one form, the cooling water flow control device further includes a flow control valve capable of opening and closing the direct flow path, and the flow control valve may be installed on the direct flow path, and operate in an open mode at the engine startup. In another form, it may operate to be closed if an ambient temperature at the engine startup is lower than a first predetermined temperature. Further, the flow control valve may operate to be opened if the ambient temperature at the engine startup is equal to or higher than the first predetermined temperature.

In another form, the cooling water flow control device may further include: a thermal management module configured to perform thermal management of the cooling water and installed on the downstream side of the engine outlet. In particular, the cooling water discharged from the engine outlet may flow to the water pump through the thermal management module. The thermal management module may be composed of a first valve member installed between the engine outlet and a radiator, a second valve member installed between the engine outlet and a heater, and a third valve member installed between the engine outlet and an automatic transmission fluid cooler.

The flow control valve may be controlled by a controller, and the controller may make the cooling water discharged from the engine flow toward the heater by closing the flow control valve and opening the second valve member if the ambient temperature at the engine startup is lower than the first predetermined temperature and the heater is in operation.

In addition, if the temperature of the cooling water of the EGR cooler is overheated to be equal to or higher than a third predetermined temperature, the controller may stop an operation of the EGR cooler and make the flow control valve operate in a closed mode, whereas if anyone of the valve members of the thermal management module is stuck during driving, the controller may make the flow control valve operate to be opened.

According to the cooling water flow control device of the cooling system for the vehicle according to the present disclosure, it is possible to make the cooling water (initial cooling water) discharged from the inside of the engine during the engine startup flow toward the cooling water outlet of the EGR cooler, and thus the warm-up time of the cooling water being circulated in the EGR cooler can be shortened.

In accordance with the shortening of the warm-up time of the cooling water of the EGR cooler, the operation start time of the EGR cooler can be shortened, and thus the EGR cooler can be early used at the engine startup. As a result, the fuel economy improvement operation using the EGR cooler can be early performed at the engine startup, and thus the engine efficiency and vehicle fuel economy can be improved.

It is understood that the term "vehicle" or "vehicular" or other similar term as used herein is inclusive of motor vehicles in general such as passenger automobiles including sport utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
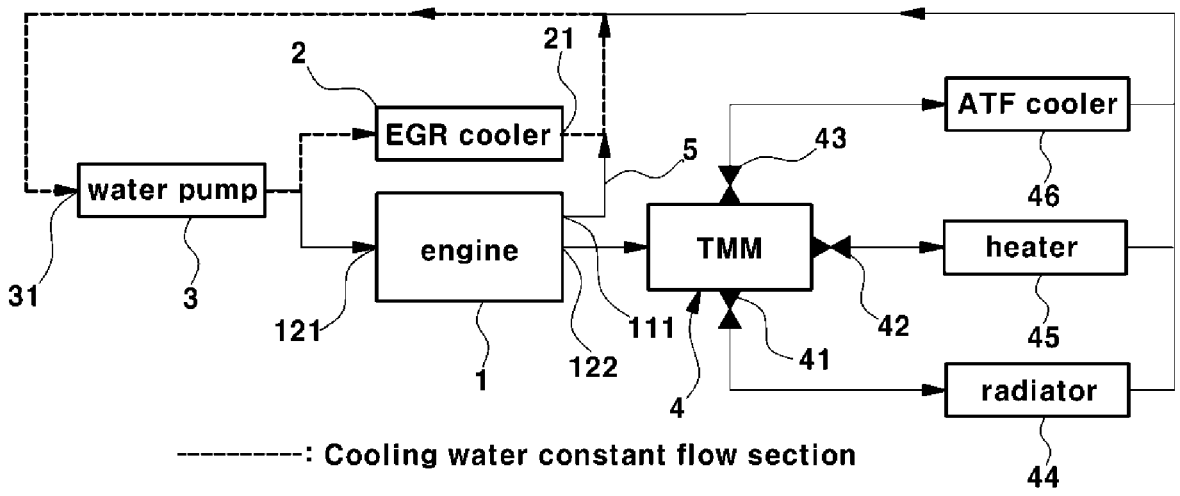
FIG. 1 is a diagram illustrating a cooling water flow control device inform of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, reference will now be made in detail to various forms of the present disclosure, examples of which are illustrated in the accompanying drawings and described below. While the present disclosure will be described in conjunction with exemplary forms, it will be understood that present description is not intended to limit the present disclosure to those exemplary forms. On the contrary, the present disclosure is intended to cover not only the exemplary forms, but also various alternatives, modifications, equivalents and other forms, which may be included within the spirit and scope of the present disclosure as defined by the appended claims.

It should be understood that the appended drawings are not necessarily to scale, presenting a somewhat simplified representation of various features illustrative of the basic principles of the present disclosure. The specific design features of the present disclosure as disclosed herein, including, for example, specific dimensions, orientations, locations, and shapes will be determined in part by the particular intended application and use environment.

A cooling water flow control device of a cooling system for a vehicle according to the present disclosure is configured to shorten a warm-up time of cooling water being supplied to an EGR cooler at a vehicle engine startup.

According to the cooling water flow control device, because the warm-up time of the cooling water that is discharged from the EGR cooler and is supplied to the water pump at the engine startup can be shortened, an operation start time of the EGR cooler can be shortened, and thus a fuel economy improvement operation in accordance with the operation of the EGR cooler can be early performed.

As illustrated in FIG. 1, the cooling water flow control device is configured to supply a part of the cooling water being discharged from the engine 1 at the engine startup toward a cooling water outlet 21 of the EGR cooler 2 (hereinafter referred to as "EGR cooler outlet").

As illustrated in FIG. 1, the vehicle cooling system may circulate the cooling water to the engine 1 and the EGR cooler 2 using one water pump 3.

The EGR cooler outlet 21 is directly connected to a cooling water inlet 31 of the water pump 3 (hereinafter referred to as "pump inlet") without separate constituent elements deployed between them. That is, the EGR cooler outlet 21 and the pump inlet 31 are directly connected to each other through a cooling water flow path deployed between them.

A cooling water outlet 122 of the engine 1 (hereinafter referred to as "engine outlet") is connected to the pump inlet 31 through a thermal management module (TMM) 4 and a thermal control device. Accordingly, at the startup of the engine 1, the cooling water being discharged from the engine 1 arrives at the pump inlet 31 relatively later than the cooling water being discharged from the EGR cooler 2.

That is, at the startup of the engine 1, the cooling water being discharged from the EGR cooler outlet 21 arrives at the pump inlet 31 relatively earlier than the cooling water being discharged from the engine outlet 122.

The cooling water flow control device is configured to make a part of the cooling water being discharged from the inside of the engine 1 (hereinafter referred to as "initial cooling water") flow toward the rear end of the EGR cooler outlet 21 (i.e., downstream of the EGR cooler outlet) at the engine startup, and as a result, the warm-up time of the cooling water flowing into the EGR cooler 2 can be shortened.

That is, because the cooling water flow control device can shorten the warm-up time of the cooling water being discharged from the EGR cooler 2 by the initial cooling water having a temperature that is relatively higher than the temperature of the cooling water being discharged from the EGR cooler 2, it is possible to early use the EGR cooler 2 without any problem, such as condensate water creation in the related art, at the engine startup, and thus a fuel economy improvement effect in accordance with the operation of the EGR cooler 2 can be secured.

In the EGR cooler 2 as illustrated in FIG. 1, the cooling water constantly circulates from the initial startup of the engine 1, and the temperature of the cooling water circulating in the EGR cooler 2 is lower than the temperature of the initial cooling water being discharged from the inside of the engine 1. Further, the flow rate of the cooling water of the EGR cooler 2 is controlled only by an engine RPM (revolutions per minute).

Because the initial cooling water being discharged from the inside of the engine 1 is supplied to the downstream side of the EGR cooler outlet 21, the warm-up time of the cooling water circulating in the EGR cooler 2 can be shortened.

In FIG. 1, the drawing reference numeral "5" denotes a direct flow path 5. The direct flow path 5 is configured to make a part of the initial cooling water being discharged from the engine 1 flow toward the downstream of the EGR cooler outlet 21. The remaining part of the initial cooling water may flow toward the thermal management module 4 through the engine outlet 122.

The direct flow path 5 is a flow path connected between a vent hole 111 of the engine 1 and the EGR cooler outlet 21. The direct flow path 5 is deployed between the vent hole 111 and the EGR cooler outlet 21 to make the cooling water being discharged through the vent hole 111 flow toward the downstream side of the EGR cooler outlet 21.

The direct flow path 5 can make the initial cooling water flow directly up to the pump inlet 31 without passing through the thermal management module 4 of the engine 1 and the thermal control device, and thus the flow path through which the initial cooling water arrives at the pump inlet 31 can be shortened. That is, the flow path of the initial cooling water can be shortened by the direct flow path 5, and the initial cooling water can directly flow to the pump inlet 31 through the direct flow path 5.

Figure 2:
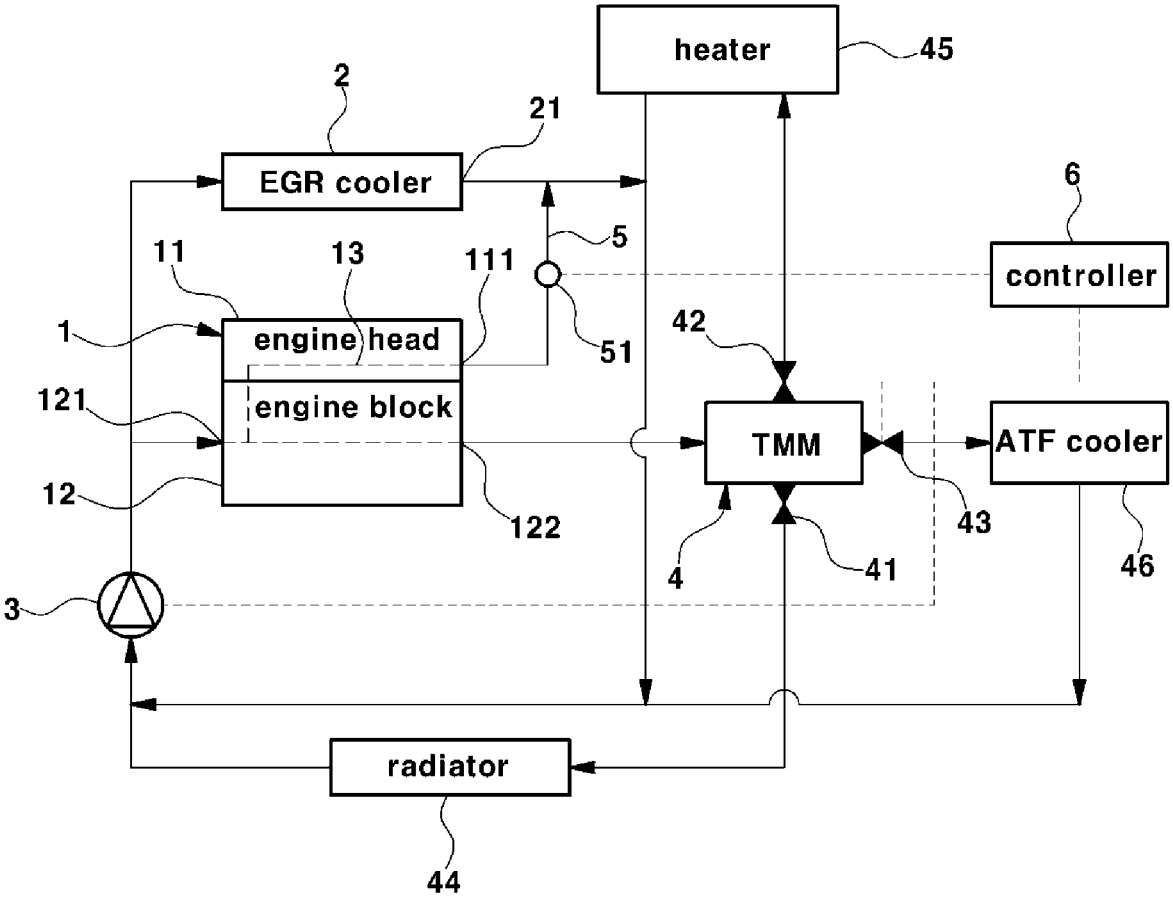
FIG. 2 is a diagram illustrating a cooling water flow control device in another form of the present disclosure.

The vent hole 111 is to discharge the cooling water of the engine 1, and is provided on the engine 1 separately from the engine outlet 122. As illustrated in FIG. 2, the vent hole 111 may be processed and provided on an engine head 11, and the engine outlet 122 may be provided on an engine block 12. The vent hole 111 makes the cooling water (i.e., initial cooling water) being kept in the cooling water flow path (i.e., water jacket) on the inside of the engine at a start-off of the engine 1 flow toward the downstream of the EGR cooler outlet 21 through the direct flow path 5 at the subsequent engine startup. That is, the vent hole 111 may interlock with the water jacket 13, and may discharge the initial cooling water being kept in the water jacket 13 toward the direct flow path 5.

The cooling water remaining in the water jacket 13 is discharged out of the engine 1 through the engine outlet 122 and the vent hole 111 by the water pump 3 at the startup of the engine 1. The initial cooling water stored in the water jacket 13 may be discharged out of the water jacket 13 when the water pump 3 is driven.

The water jacket 13 is provided on the engine head 11 that covers the engine block 12 and combustion chambers of the engine block 12 (refer to FIG. 2). The water jacket 13 is deployed on outsides of the combustion chambers and is formed to surround the respective combustion chambers. The water jacket 13 is provided with a cooling water inlet (hereinafter referred to as "engine inlet") 121 for inflow of the cooling water and the engine outlet 122. In this case, the engine inlet 121 and the engine outlet 122 are deployed on the engine block 12.

Further, as illustrated in FIG. 2, a flow control valve 51 may be installed on the direct flow path 5. The flow control valve 51 is configured to open and close the direct flow path 5, and controls the cooling water flow and the flow rate in the direct flow path 5. The flow control valve 51 may control the flow of the cooling water flowing from the vent hole 111 to the EGR cooler outlet 21. The flow control valve 51 is a one-way valve permitting the cooling water flow from the vent hole 111 to the EGR cooler outlet 21 only. The opening rate of the flow control valve 51 may be controlled by a controller 6 provided within the vehicle. The controller 6 may be an engine controller controlling an engine system of the vehicle.

The flow control valve 51 may operate to be opened by the controller 6 at the engine startup to open the direct flow path 5. That is, if the startup of the engine 1 is detected, the controller 6 may open the flow control valve 51 to make the initial cooling water flow in the direct flow path 5.

Further, the controller 6 may control the opening and closing of the flow control valve 51 in accordance with an ambient temperature at the engine startup.

Figure 3:
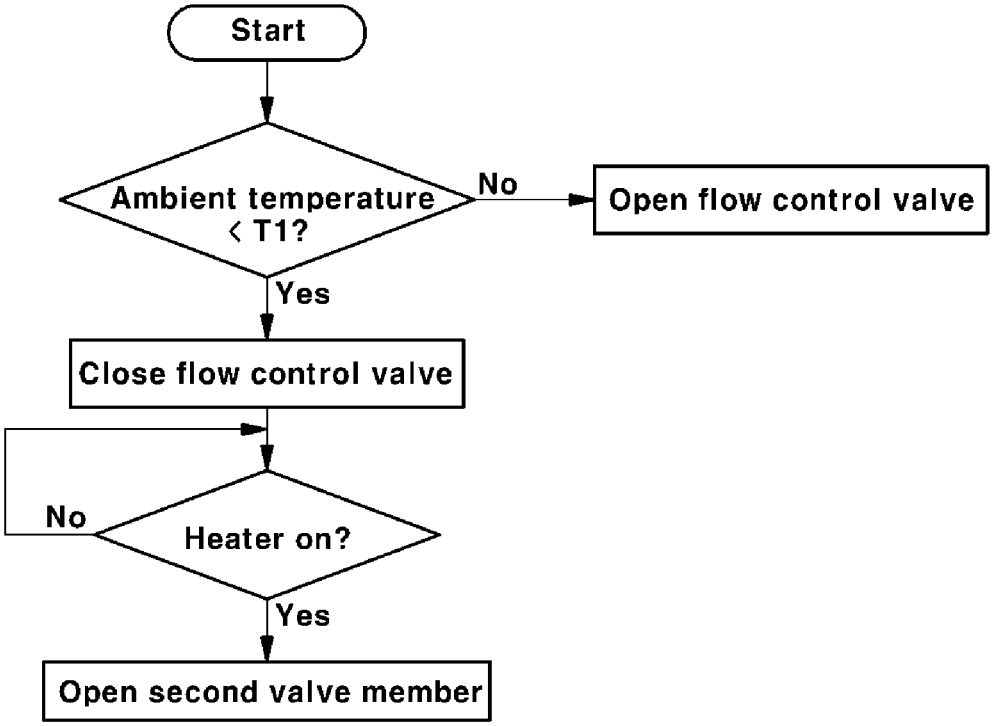
FIG. 3 is a diagram illustrating a cooling water flow control method at an engine startup in one form of the present disclosure.

In one form, if the ambient temperature is equal to or higher than a first predetermined temperature T1, the controller 6 may open the flow control valve 51 (refer to FIG. 3). The ambient temperature may be detected by an ambient temperature sensor installed on the vehicle.

If the exhaust gas (i.e., EGR gas) that is cooled by the EGR cooler 2 is supplied to the engine 1 in a state where the ambient temperature is low, condensate water may be created in an intake system of the engine 1. The intake system is provided with a sensor that detects an intake pressure, and if the condensate water is created and frozen on the sensor, the sensor is unable to detect the intake pressure.

To cope with this, the controller 6 may inhibit or prevent a large amount of condensate water from being created in the intake system of the engine 1 by opening the flow control valve 51 only in the case where the ambient temperature is equal to or higher than the first temperature T1.

That is, if the ambient temperature detected at the engine startup is lower than the first temperature T1, the controller 6 may operate the flow control valve 51 in a closed mode (refer to FIG. 3).

If the flow control valve 51 operates to be opened, the initial cooling water of the engine may flow from the vent hole 111 to the EGR cooler outlet 21 through the direct flow path 5, whereas if the flow control valve 51 operates to be closed, the cooling water flow through the direct flow path 5 is blocked. If the cooling water flow through the direct flow path 5 is blocked by the flow control valve 51, the initial cooling water being discharged from the vent hole 111 does not flow toward the EGR cooler outlet 21.

As illustrated in FIG. 2, the thermal management module 4, which may be controlled in accordance with the cooling water temperature and the ambient temperature, is connected to the engine outlet 122. The thermal management module 4 may be deployed on the downstream of the engine outlet 122 for thermal management of the cooling water that circulates in the engine. The thermal management module 4 may perform thermal management of the cooling water using the plurality of valve members 41, 42, and 43 and the thermal control device deployed on the downstream of the thermal management module 4. The thermal control device may be composed of a radiator 44, a heater 45, and an automatic transmission fluid cooler 46 being deployed on the downstream of the engine outlet 122.

The thermal management module 4 may be configured to include the plurality of valve members 41, 42, and 43 capable of controlling the flow of the cooling water that is discharged from the engine outlet 122. The plurality of valve members 41, 42, and 43 may be the first valve member 41, the second valve member 42, and the third valve member 43.

The first valve member 41 may be installed in a flow path connected between the engine outlet 122 and the radiator 44. That is, the first valve member 41 may be deployed on an upstream of the radiator 44 to control the flow rate of the cooling water that flows from the engine outlet 122 to the radiator 44.

The second valve member 42 may be installed in a flow path connected between the engine outlet 122 and the heater 45. That is, the second valve member 42 may be deployed on an upstream of the heater 45 to control the flow rate of the cooling water that flows from the engine outlet 122 to the heater 45.

The third valve member 43 may be installed in a flow path connected between the engine outlet 122 and the automatic transmission fluid cooler 46. That is, the third valve member 43 may be deployed on an upstream of the automatic transmission fluid cooler 46 to control the flow rate of the cooling water that flows from the engine outlet 122 to the automatic transmission fluid cooler 46.

The valve members 41, 42, and 43 may receive control signals transmitted from the controller 6, and may control their opening rates. The controller 6 may control the opening and closing operations of the valve members 41, 42, and 43 in accordance with the cooling water temperature and the ambient temperature. That is, the thermal management module 4 may control the operations of the valve members 41, 42, and 43 based on the cooling water temperature and the ambient temperature. The temperature of the cooling water may be detected by a water temperature sensor (WTS) to be transmitted to the controller 6.

The water temperature sensor may be installed in the engine intake system to measure the temperature of the cooling water flowing into the engine 1, or it may be installed in the cooling water flow path between the engine outlet 122 and the thermal management module 4 to detect the temperature of the cooling water being discharged from the engine outlet 122.

The controller 6 may control the flow of the cooling water discharged from the engine outlet 122 by controlling the opening and closing operations of the valve members 41, 42, and 43. The controller 6 may stop the flow of the cooling water that circulates in the engine by closing the first to third valve members 41, 42, and 43 in all.

Further, the controller 6 may make the cooling water being discharged from the engine outlet 122 to the engine inlet 121 by opening one or two or more valve members selected from the first to third valve members 41, 42, and 43.

The cooling water flowing toward the radiator 44 may be cooled as passing through the radiator 44, and then may flow toward the engine output 122. The cooling water flowing toward the heater 45 may be heated by the heater 45, and then may flow toward the engine outlet 122. Further, the cooling water flowing toward the automatic transmission fluid cooler 46 may be heated through heat exchange with the automatic transmission fluid (AFT). The automatic transmission fluid cooler 46 may be a heat exchanger configured to cool the automatic transmission fluid using the cooling water.

On the downstream of the radiator 44, the heater 45, and the automatic transmission fluid cooler 46, the water pump 3 is deployed. The water pump 3 may be driven whenever the engine starts. If the cooling water flow toward the engine outlet 122 is blocked by the thermal management module 4 in the case where the driving of the water pump 3 starts, the cooling water may circulate only in the EGR cooler 2, and it may not circulate in the engine 1.

Here, with reference to FIGS. 3 to 5, a cooling water flow control method at an engine startup will be described in more detail.

As illustrated in FIG. 3, if the ambient temperature is lower than the first temperature T1 at the engine startup, the controller 6 operates the EGR valve 22 in the closed mode.

Figure 4:
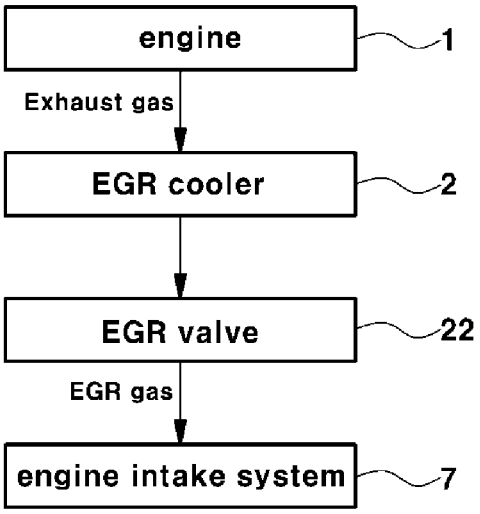
FIG. 4 is a schematic diagram illustrating an EGR system in one form of the present disclosure.

As illustrated in FIG. 4, the EGR cooler 2 cools the exhaust gas that is discharged from the engine 1 and recirculates to an engine intake system 7, and the exhaust gas (e.g., EGR gas) being cooled by the EGR cooler 2 may pass through the EGR valve 22 and may flow to the engine intake system 7. In this case, the flow rate of the EGR gas being supplied to the engine intake system 7 by the EGR valve 22 may be controlled.

The first temperature T1 may be configured as a temperature value at which it is worried that a large amount of condensate water is created and frozen in the engine intake system 7 due to a low ambient temperature. For example, the first temperature T1 may be 10° C. If the ambient (i.e., intake air) temperature being supplied to the engine 1 is lower than the first temperature T1, a large amount of condensate water may be created and frozen in the engine intake system 7 due to the temperature difference between the intake air and the exhaust gas (i.e., EGR gas) being supplied to the engine intake system 7 through the EGR valve 22.

More specifically, in an intake manifold of the engine intake system 7, the condensate water may be created by the EGR gas recirculating to the engine intake system 7 through the EGR cooler 2. If the ambient temperature is lower than the first temperature T1, a large amount of condensate water is created and frozen in the intake manifold due to the temperature difference between the EGR gas and the intake air, and thus an intake pressure sensor installed on the intake manifold is frozen to cause a normal operation of the intake pressure sensor to be impossible.

Accordingly, if the ambient temperature is lower than the first temperature T1, the controller 6 may not operate the EGR cooler 2 in order to inhibit or prevent the intake pressure sensor from being frozen, and if the EGR cooler 2 is not operated, it is not necessary to warm up the cooling water being supplied toward the EGR cooler 2, and thus the flow control valve 51 is operated in the closed mode.

Further, if the ambient temperature is lower than the first temperature T1 at the engine startup and the heater 45 is in operation, the controller 6 blocks the flow of the initial cooling water to the direct flow path 5 by closing the flow control valve 51, and simultaneously makes the initial cooling water flow toward the heater 45 by opening the second valve member 42.

In other words, if the heater 45 is in operation in a state where the ambient temperature at the engine startup is lower than the first temperature T1, the controller 6 may close the flow control valve 51 while opening the second valve member 42. In this case, the initial cooling water being discharged from the engine 1 through the engine outlet 122 may flow toward the heater 45, is heated by the heater 45, and then flows to the pump inlet 31. The initial cooling water being heated by the heater 45 may flow to the engine inlet 121 by the water pump 3, and thus the warm-up time of the cooling water can be greatly shortened.

Figure 5:
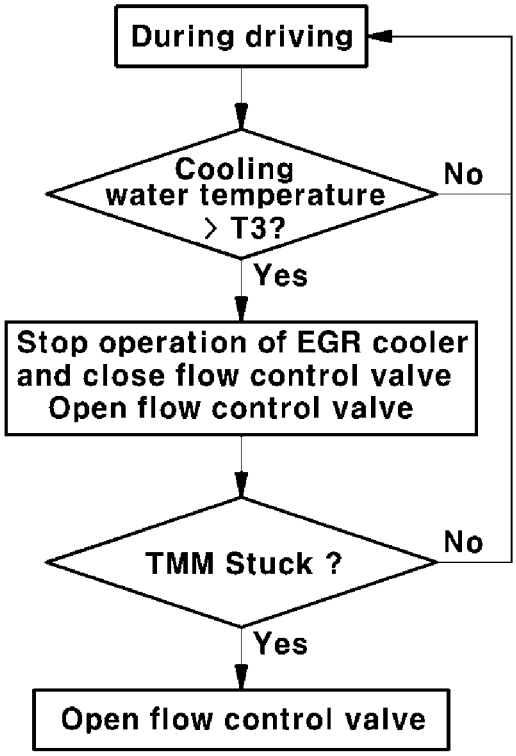
FIG. 5 is a diagram illustrating a cooling water flow control method during driving in another form of the present disclosure.

In one form, as illustrated in FIG. 5, if the cooling water temperature detected during driving of the vehicle is equal to or higher than a third predetermined temperature T3 after the warm-up of the cooling water is completed, the controller 6 closes the flow control valve 51.

If the cooling water is heated by the engine 1 and the EGR cooler 2 during driving and the temperature of the cooling water becomes equal to or higher than the third temperature T3, the heat transfer rate (i.e., heat transfer amount) of the EGR cooler 2 may be lowered to a very low level (e.g., about 5%). Here, the third temperature T3 may be, for example, 110° C.

If the heat transfer rate of the EGR cooler 2 is reduced to a very low level, it may be determined that the operation of the EGR cooler 2 is unnecessary, and if the operation of the EGR cooler 2 is unnecessary, it is not required to open the direct flow path 5.

Accordingly, if the cooling water temperature of the EGR cooler 2 is increased over the third temperature T3, the controller 6 stops the operation of the EGR cooler 2, and operates the flow control valve 51 in a closed mode to block the flow of the cooling water toward the EGR cooler 2 through the direct flow path 5.

Further, if the valve members 41, 42, and 43 of the thermal management module 4 are all stuck to cause the cooling water flow through the thermal management module 4 to be impossible, the controller 6 operates the flow control valve 51 in an open mode although the cooling water temperature is equal to or higher than the third temperature T3, and thus the engine 1 can be prevented from overheating through the cooling water circulation.

Figure 6:
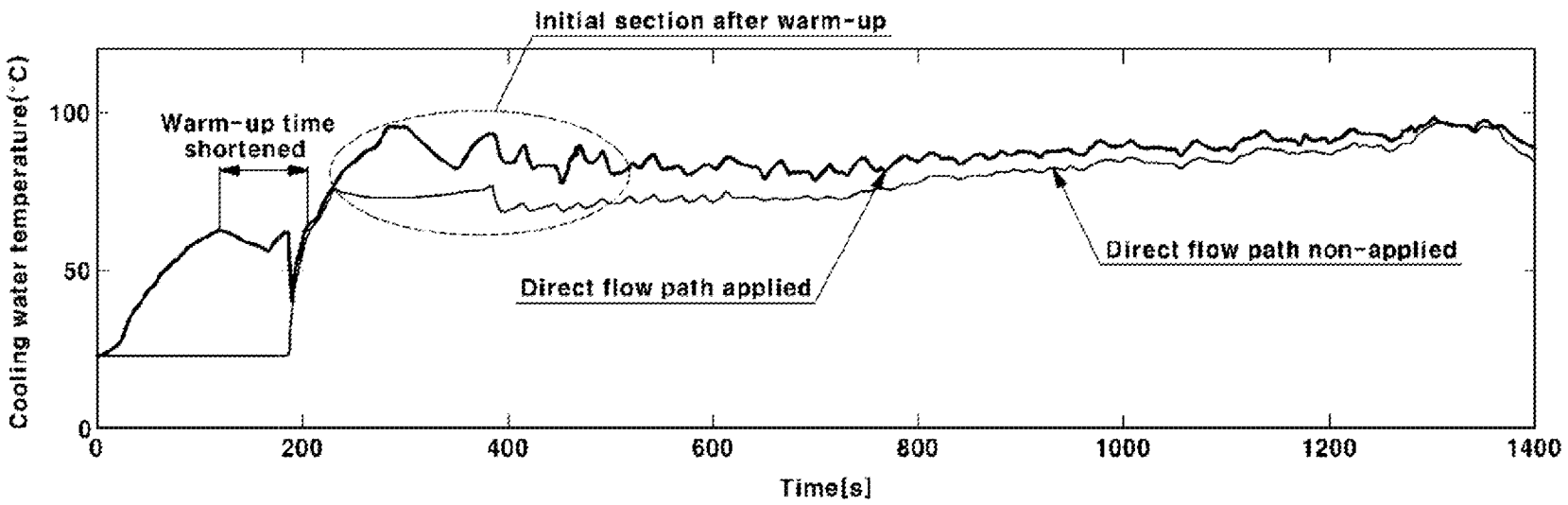
FIG. 6 is a graph of experimental results showing warm-up time shortening effects of cooling water in one form of the present disclosure.

FIG. 6 is a graph of the experimental results showing the warm-up time shortening effects of the cooling water by warming up the cooling water using the direct flow path 5.

As illustrated in FIG. 6, if the initial cooling water of the engine flows toward the EGR cooler outlet 21 through the direct flow path 5, the warm-up time of the cooling water on the side of the EGR cooler 2 can be shortened in comparison with a case where the direct flow path 5 is not applied, and a higher cooling water temperature can be kept in an initial section after the warm-up. If the higher cooling water temperature is kept in the initial section after the warm-up, a frictional loss of the engine is reduced, and thus the fuel economy can be improved.

The present disclosure has been described in detail with reference to the exemplary forms thereof. However, it will be appreciated by those skilled in the art that changes may be made in these forms without departing from the principles and spirit of the present disclosure.

What is claimed is:

1. A cooling water flow control device of a cooling system for a vehicle, comprising:

an exhaust gas recirculation (EGR) cooler configured to cool an exhaust gas supplied to an intake system of an engine using cooling water and including an EGR cooler outlet through which the cooling water is discharged, wherein the engine is provided with an engine outlet and a vent hole for discharging the cooling water;

a water pump configured to circulate the cooling water to the EGR cooler and the engine at an engine startup; and a direct flow path configured to guide the cooling water from the vent hole to a downstream side of the EGR cooler outlet, wherein the vent hole is provided on an engine head and the engine outlet is provided on an engine block, and wherein the vent hole is connected to the direct flow path and the engine outlet is connected to a thermal management module which is arranged on a downstream of the engine outlet and configured to perform a thermal management of the cooling water discharged through the engine outlet.

2. The cooling water flow control device of claim 1, further comprising: a flow control valve configured to open and close the direct flow path, wherein the flow control valve is installed on the direct flow path, and configured to operate in an open mode at the engine startup.

3. The cooling water flow control device of claim 2, wherein when an ambient temperature at the engine startup is lower than a first predetermined temperature, the flow control valve is closed.

4. The cooling water flow control device of claim 3, wherein when the ambient temperature at the engine startup is equal to or higher than the first predetermined temperature, the flow control valve is open.

5. The cooling water flow control device of claim 3, further comprising: a thermal management module configured to perform thermal management of the cooling water and installed on the downstream side of the engine outlet, wherein the cooling water discharged from the engine outlet flows to the water pump through the thermal management module.

6. The cooling water flow control device of claim 5, wherein the thermal management module comprises:

a first valve member installed between the engine outlet and a radiator;

a second valve member installed between the engine outlet and a heater; and a third valve member installed between the engine outlet and an automatic transmission fluid cooler.

7. The cooling water flow control device of claim 6, wherein:

the flow control valve is controlled by a controller, and when the ambient temperature at the engine startup is lower than the first predetermined temperature and the heater is in operation, the controller is configured to close the flow control valve and open the second valve member such that the cooling water discharged from the engine flows toward the heater.

8. The cooling water flow control device of claim 7, wherein when a temperature of the cooling water of the EGR cooler is equal to or higher than a third predetermined temperature, the controller is configured to stop an operation of the EGR cooler, and operate the flow control valve in a closed mode.

9. The cooling water flow control device of claim 8, wherein when at least one of the first valve member, the second valve member, or the third valve member of the thermal management module is stuck during driving, the controller is configured to control the flow control valve to be open.

10. The cooling water flow control device of claim 2, wherein the flow control valve is a one-way valve configured to permit the cooling water to flow from the vent hole to the EGR cooler outlet only at the engine startup.

* * * * *